US007683845B2

(12) United States Patent
Wynn

(10) Patent No.: US 7,683,845 B2
(45) Date of Patent: Mar. 23, 2010

(54) ANTENNA SYSTEM COMPENSATING A CHANGE IN RADIATION CHARACTERISTICS

(75) Inventor: Duncan A Wynn, Malvern (GB)

(73) Assignee: QinetiQ Limited, London (GB)

( * ) Notice: Subject to any disclaimer, the term of this patent is extended or adjusted under 35 U.S.C. 154(b) by 319 days.

(21) Appl. No.: 11/664,125

(22) PCT Filed: Sep. 29, 2005

(86) PCT No.: PCT/GB2005/003720

§ 371 (c)(1),
(2), (4) Date: Mar. 30, 2007

(87) PCT Pub. No.: WO2006/037953

PCT Pub. Date: Apr. 13, 2006

(65) Prior Publication Data

US 2008/0117119 A1 May 22, 2008

(30) Foreign Application Priority Data

Oct. 2, 2004 (GB) ..... 0421956.4

(51) Int. Cl.
*H01Q 3/00* (2006.01)
*H01Q 1/32* (2006.01)
*H01Q 1/42* (2006.01)

(52) U.S. Cl. ..... 343/757; 713/765; 713/872

(58) Field of Classification Search ..... 343/711, 343/713, 757, 763, 765, 766, 872, 882
See application file for complete search history.

(56) References Cited

U.S. PATENT DOCUMENTS

| | | | | |
|---|---|---|---|---|
| 3,940,767 | A | 2/1976 | Delano et al. | |
| 4,499,473 | A | 2/1985 | Rao | |
| 5,952,980 | A | 9/1999 | Boling | |
| 6,195,060 | B1 * | 2/2001 | Spano et al. | 343/766 |
| 6,404,399 | B1 | 6/2002 | Morita | |
| 6,864,846 | B2 * | 3/2005 | King | 343/757 |
| 6,937,199 | B2 * | 8/2005 | King | 343/757 |
| 7,358,498 | B2 * | 4/2008 | Geng et al. | 250/347 |

FOREIGN PATENT DOCUMENTS

| | | |
|---|---|---|
| EP | 0 656 671 | 6/1995 |
| GB | 2 154 802 | 9/1985 |
| GB | 2 295 493 | 5/1996 |
| JP | 04-321303 | 11/1992 |
| JP | 06-138199 | 5/1994 |
| JP | 2003-224414 | 8/2003 |
| WO | 98/40761 | 9/1998 |

OTHER PUBLICATIONS

International Search Report for PCT/GB05/03720 mailed Nov. 28, 2005.
UK Search Report for GB 0421956.4, date of search Dec. 8, 2004.
Huang et al., *The effect of radome on the transmitted electromagnetic field*, Antennas and Propagation Society International Symposium, Jun. 21-26, 1998, pp. 2194-2197, XP010292125.

* cited by examiner

*Primary Examiner*—Shih-Chao Chen
(74) *Attorney, Agent, or Firm*—Nixon & Vanderhye PC.

(57) ABSTRACT

An antenna system having a transmissive surface and an antenna arranged to transmit or receive radiation through the transmissive surface via a radiation lobe of the antenna. The system further includes a displacing arrangement to displace the radiation lobe of the antenna relative to the transmissive surface as necessary so as to reduce a change in one or more characteristics of the radiation on passing through the transmissive surface. A corresponding method is additionally described.

12 Claims, 3 Drawing Sheets

ANTENNA SYSTEM COMPENSATING A CHANGE IN RADIATION CHARACTERISTICS

This application is the U.S. national phase of international application PCT/GB2005/003720 filed 29 Sep. 2005, which designated the U.S. and claims benefit of GB 0421956.4 filed 2 Oct. 2004, the entire contents of each of which are hereby incorporated by reference.

BACKGROUND OF THE INVENTION

1. Field of the Invention

The invention relates to antenna systems in which an antenna is arranged to transmit or receive radiation through a transmissive surface.

2. Discussion of Prior Art

There are a number of situations in which an antenna lobe is directed through a transmissive surface. For example, a monolithic microwave integrated circuit (MMIC) package may comprise a MMIC chip having an antenna, the chip being contained with a ceramic package. Electromagnetic (EM) energy is transmitted or received through the ceramic package in one or more radiation lobes of the antenna. Another example is in the field of microwave wireless LANs in which microwave communication between electronic devices may take place through a transmissive surface. A further example is an antenna system in which an antenna is protected by a radome, and wherein EM energy is transmitted or received by the antenna through the radome. A radome is physical covering for protecting an enclosed antenna from adverse environmental effects such as electrical and structural degradation caused by extremes of moisture temperature, pressure and vibration. In the case of aircraft-mounted antenna systems, a radome also provides protection against aerodynamic stress, kinematic heating and birdstrike.

Transmission or reception of radiation by an antenna through a transmissive surface frequently gives rise to adverse effects on one or more characteristics of the radiation for certain parameters, or combinations of parameters, of the transmitted or received radiation such as antenna lobe position and direction with respect to the surface, frequency, and polarisation. For example, for certain combinations of antenna lobe position and direction, standing waves may be set up between the antenna and the surface when the antenna is transmitting at a certain frequency, resulting in reduced transmission efficiency of the radiation. The amplitude of the radiation is therefore reduced as it passes through the transmissive surface. The presence of the transmissive surface also generally gives rise to a deviation in the direction of transmitted or received radiation on passing through the surface. For example in the case of an antenna system having an antenna provided with a radome, this effect results in boresight error, i.e. a difference in the direction in which radiation leaves the antenna and the direction in which it propagates after passing through the radome.

Under certain conditions, a portion of the radiation transmitted by the antenna may be transmitted along the surface. In addition to representing an additional transmission loss mechanism this can have other undesirable effects. For example in the case of an antenna system comprising an antenna provided with a radome, EM energy may be conducted along the surface of the radome to the radome's fixing points from where EM energy is radiated into a large solid angle, potentially interfering with other antenna systems nearby.

In the case of high-bandwidth signals, diffraction and dispersion effects at the surface may give rise to an undesirable angular dispersion of a transmitted or received radiation on passing through the surface. Certain parameters, or combinations of parameters, of the transmitted or received radiation may also result in its polarisation being affected in an undesirable way.

Thus one or more characteristics of transmitted or received EM radiation, such as angular extent, direction, amplitude and polarisation may be affected on passing through the surface.

It is an object of the invention to ameliorate one or more of these problems.

SUMMARY OF THE INVENTION

According to a first aspect of the present invention, there is provided an antenna system comprising a transmissive surface and an antenna arranged to transmit or receive radiation through the transmissive surface via a radiation lobe of the antenna, characterised in that the system further comprises displacing means arranged to displace the radiation lobe of the antenna relative to the transmissive surface as necessary so as to reduce a change in a characteristic, or combination of characteristics, of the radiation on passing through the transmissive surface. For example, the characteristic, or combination of characteristics, the change in which is to be minimised may be one or more of the amplitude, direction, angular extent and polarisation of the radiation.

An example system of the invention comprises an antenna provided with a radome, with the displacing means being arranged to displace a radiation lobe of the antenna as necessary such that transmission through the radome is maximised (i.e. the change in amplitude of the energy as it passes through the radome is minimised) for example by avoiding standing wave conditions within the radome, subject to a particular required orientation of the radiation lobe. In another example system having a radome, the radiation lobe may be displaced so as to minimise boresight error, subject to a desired orientation of the lobe.

To allow better optimisation of the antenna system, the displacing means is preferably arranged to provide independent linear displacement of the radiation lobe in two, or more preferably, three mutually orthogonal directions with respect to the transmissive surface. Providing for the radiation lobe to be displaced with respect to the radome in more than one mutually orthogonal direction, allows greater flexibility to further reduce a change in a characteristic, or combination of characteristics, of the energy as it passes through the transmissive surface. An additional advantage is that a radiation lobe position corresponding to a small change in a characteristic of the radiation passing through the surface may on occasion be reached by a relatively small displacement in a direction having components in two or three mutually orthogonal directions, whereas a relatively large displacement along a single one of these directions may be required to achieve the same effect.

If the antenna is a mechanical antenna, such as parabolic dish, displacement of the radiation lobe is conveniently achieved by displacement of the antenna itself with respect to the transmissive surface. This also applies in the case of a conventional phased array antenna, a radiation lobe of which may be steered electronically (although not displaced electronically). If the antenna is of a type wherein a radiation lobe of the antenna may be displaced electronically, then the displacing means are electronic means for performing this function. An example of the latter type of antenna is a two-dimensional array of individual antenna elements wherein a particular row or column (or, more generally, sub-group) of elements may be operated as a phased array antenna. Radiation lobe displacement may be achieved by changing the sub-group of elements that is operated.

The invention is particularly beneficial in the context of steerable antenna systems, i.e. systems in which a radiation lobe of the antenna may be steered through a certain solid angle by changing the azimuth and/or elevation of the lobe by use of steering means. In these systems it is frequently the case that, for a desired radiation lobe direction, the current position of the lobe is such that there is a significant change in a characteristic (e.g. amplitude) of transmitted or received radiation as it passes through the transmissive surface. Moreover, the change typically varies with azimuth and elevation of the radiation lobe. Hence in steerable systems it is particularly advantageous to have a facility to displace the radiation lobe in cases where steering the lobe in a desired direction gives rise to an unacceptably large change in a particular characteristic of the radiation transmitted or received by the antenna.

In the case of systems having a mechanical or conventional (linear) phased array antenna, the functions of steering and antenna displacement may both conveniently be achieved by mounting the antenna on a Stewart platform. Alternatively the antenna may be mounted on a first support member which is pivotally mounted on a second support member such that the first support member may be rotated in elevation, and means provided for rotating the second support member, and hence also the antenna, in azimuth.

A second aspect of the invention provides a method of transmitting or receiving radiation through a transmissive surface using an antenna, the method comprising the step of displacing a radiation lobe of the antenna as necessary with respect to the transmissive surface so as to reduce a change in a characteristic, or combination of characteristics, of the radiation on passing through the transmissive surface.

The step of displacing the radiation lobe is conveniently carried out by displacing the antenna with respect to the transmissive surface.

The method is conveniently carried out by initially establishing antenna positions, for each of a series of sets of characteristics of transmitted or received radiation, for which a change in a characteristic, or combination of characteristics, of the energy on passing through the transmissive surface is less than a pre-determined value. This may be done experimentally, or by computer modelling of a particular antenna system. For a particular set of required characteristics, the antenna is then displaced to one of these positions.

BRIEF DESCRIPTION OF THE DRAWINGS

Embodiments of the invention are described below by way of example only and with reference to the accompanying drawings in which.

DETAILED DISCUSSION OF EMBODIMENTS

Figure 1:
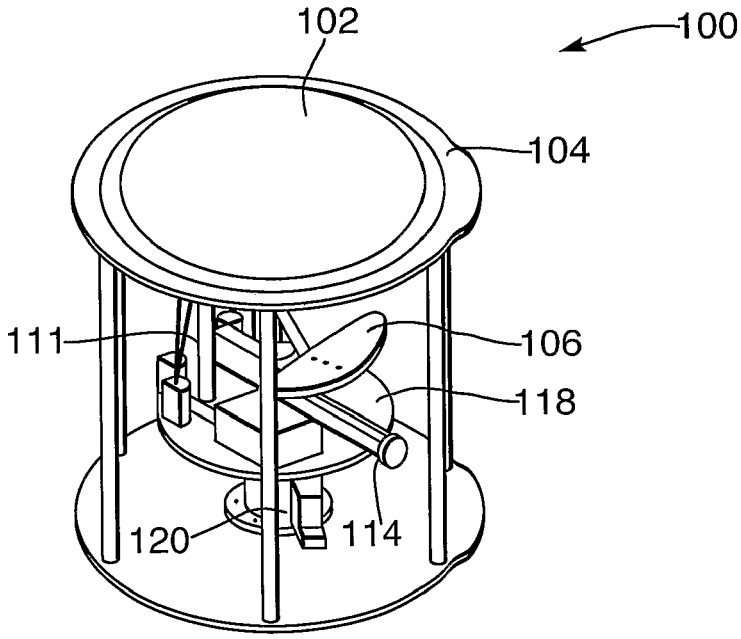
FIG. 1 is an isometric view of an antenna system of the invention, the system having a radome.
Figure 2:
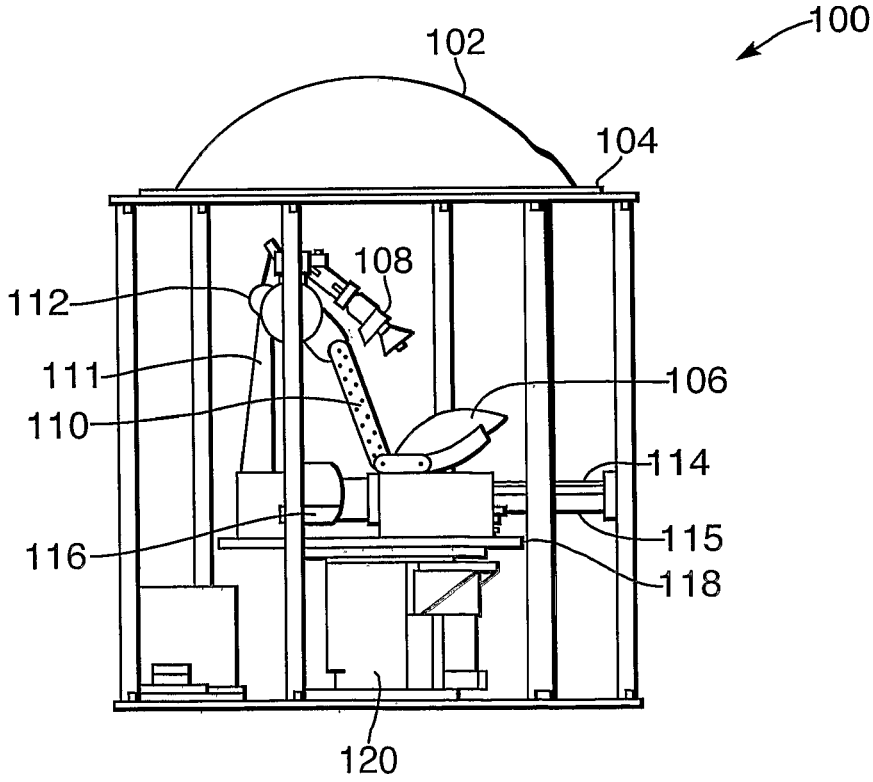
FIG. 2 is a side view of the FIG. 1 system.
Figure 3:
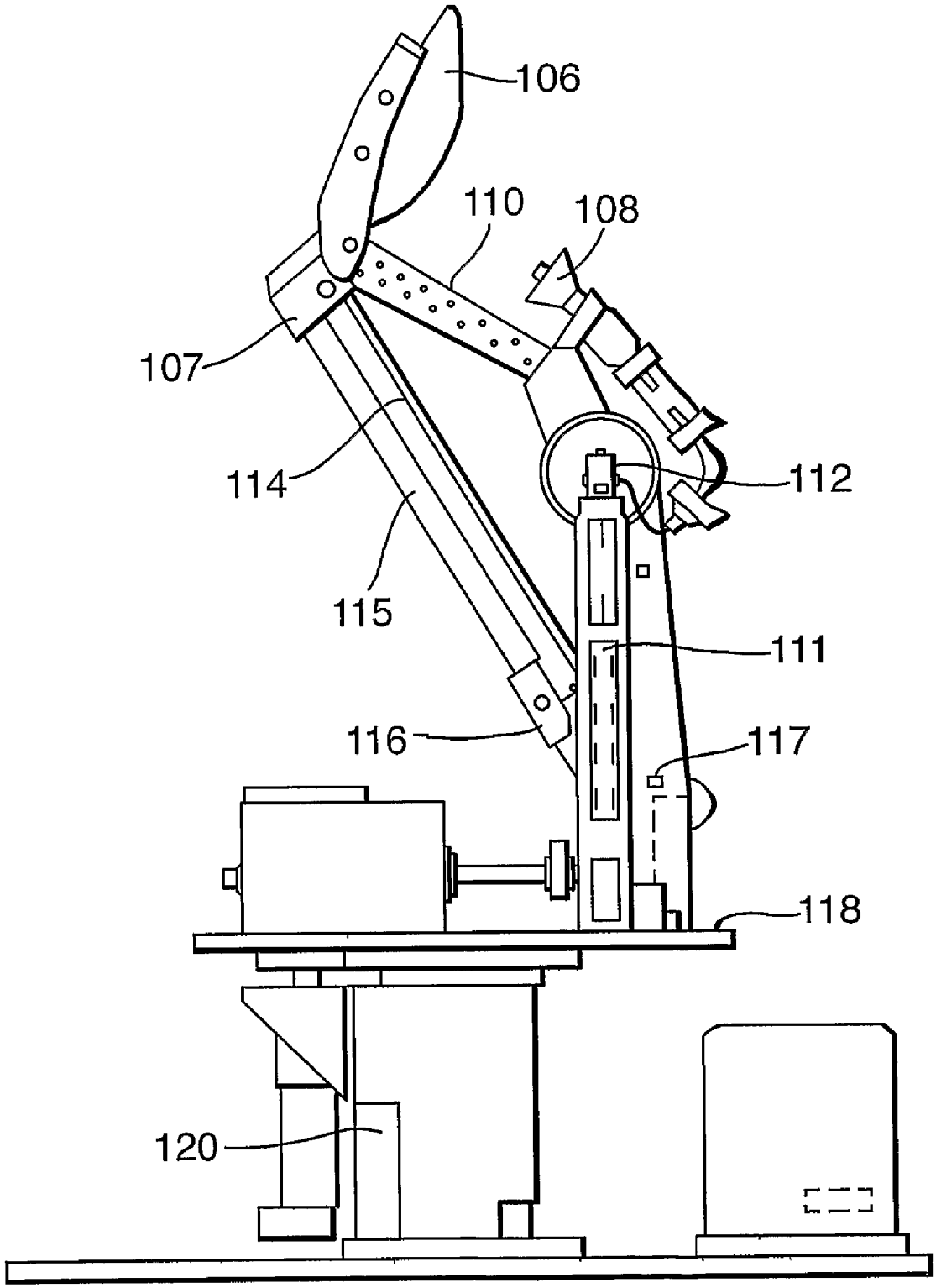
FIG. 3 is a side view of the FIG. 1 system with its radome omitted for greater clarity.

Referring to FIGS. 1, 2 and 3, an antenna system 100 of the invention comprises a parabolic dish antenna 106 and a feed 108 mounted on an arm 110 in an offset-Cassegrain arrangement. The arm 110 is pivotally mounted on a substantially vertical support 111 so that the arm 110 may be rotated in a vertical plane. A chuck 107 pivotally mounted on the arm 110 is arranged to slide on a smooth support bar 115 and also co-operates with a threaded control rod 114 parallel to the bar 115. The end of control rod 114 remote from the antenna 106 is coupled to a motor (not shown) which is arranged to rotate the threaded control rod 114 about its longitudinal axis. The motor and the support bar 115 are both fixed in a housing 116 which is pivotally mounted on the vertical support 111 for rotation about a horizontal axis 117. Operation of the motor causes the chuck 107 to move along the support bar 115 thus allowing the elevation $\theta$ of the arm 110, and hence also the main radiation lobe of the dish antenna 106, to be adjusted.

The vertical support 111 is mounted on a circular platform 118 which may be rotated about a vertical axis through its centre by a motor system 120 to vary the azimuth $\phi$ of the antenna 106. Motor system 120 also allows the platform 118 (an hence the antenna dish 106) to be moved vertically along said vertical axis.

The system 100 forms part of a 45 GHz satellite communications system intended for mounting on a vehicle. The system 100 is provided with a convex polycarbonate radome 102 having a flange 104 for attachment to the vehicle's surface. In use, most parts of the system 100 lie within the body of the vehicle.

Operation of the motor system 120 and the motor coupled to the control rod 114 allows the elevation $\theta$ and azimuth $\phi$ of the antenna's main radiation lobe to be steered as desired; furthermore the lobe may be displaced by operating the motor system 120 so as to vertically displace the platform 118.

The system 100 further comprises control means (not shown) for controlling the vertical displacement of the platform 118. Prior to operation of the system 100, an acceptable value of transmission efficiency is determined. For each of a series of antenna directions, transmission efficiency through the radome is measured (or calculated) for a series of antenna positions relative to the radome. Those combinations of antenna position and direction corresponding to a transmission efficiency at or above the acceptable value are stored by the control means.

Figure 4:
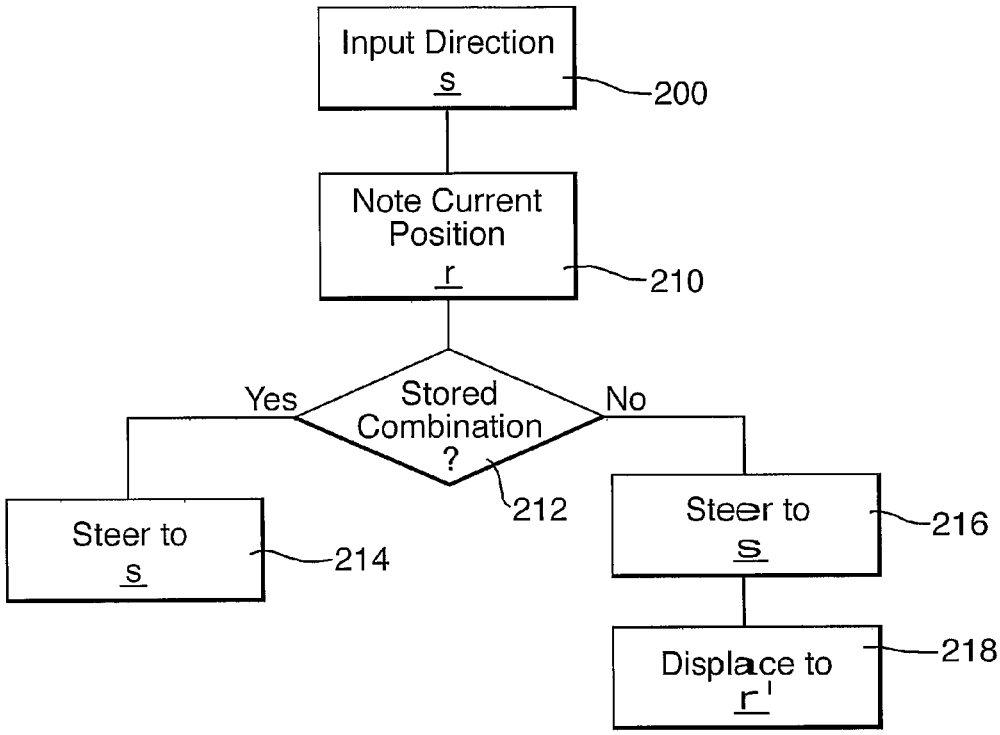
FIG. 4 is a flow chart relating to steering of the FIG. 1 system.

FIG. 4 illustrates operation of the control means when the system 100 is in use. The control means is arranged to receive input of data from an operator (200), the data corresponding to a desired direction $s(\theta,\phi)$ of the antenna system. The current position r of the antenna is established (210). If the combination s, r is a combination that has previously been stored (212), then the control means outputs control signals to the system motors so that the antenna is steered in the direction s (214). If the combination has not previously been stored (212) then the antenna is steered in the direction s (216) and also displaced to a position r' where the combination s, r' has previously been stored (218). If there are several such positions then the antenna position assumed is the one such that $|r'-r|$ is minimised, thus minimising the time taken to displace the antenna.

In another embodiment of the invention, a parabolic dish antenna of the type having a sub-reflector at a focus and a feed passing through the dish is mounted within a convex radome on a Stewart platform. Stewart platforms are commonly used in flight simulators, active vibration isolation and positioning applications, e.g. precision machining, and are described in Proc. Inst. Mech. Engr. 180(1), 371-386 (1965). The Stewart platform allows the antenna to be displaced by any amount along any of three mutually orthogonal directions or by any combination of such displacements, in addition to providing elevation and azimuth rotation of the antenna. The Stewart platform is simple, compact and allows displacement and rotation of the antenna with high accuracy.

Figure 5:
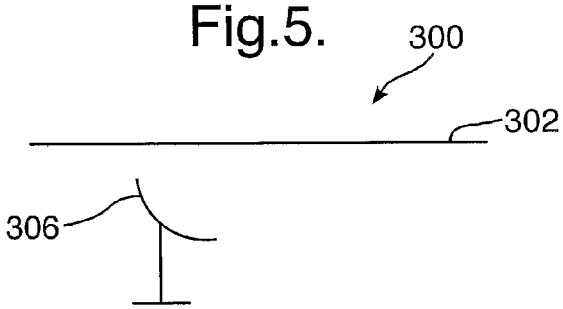
FIGS. 5 & 6 illustrate further example systems of the invention.
Figure 6:
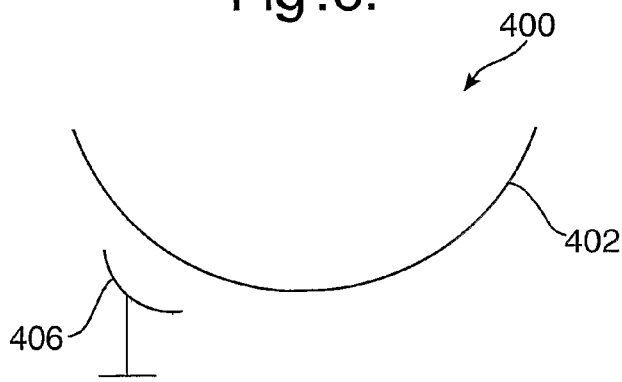

In FIG. 5, an alternative antenna system 300 of the invention comprises an antenna 306 provided with a planar radome 302. In FIG. 6, a further alternative antenna system 400 of the invention comprises an antenna 406 provided with a concave radome 402.

The invention claimed is:

1. An antenna system comprising:

a transmissive surface;

an antenna arranged to transmit or receive radiation through the transmissive surface via a radiation lobe of the antenna;

steering means for steering said radiation lobe of said antenna in at least one of azimuth and elevation; and displacing means for displacing the radiation lobe of the antenna relative to the transmissive surface to reduce a change in at least one characteristic of the radiation on passing through the transmissive surface.

2. A system according to claim 1 wherein the characteristic, or combination of characteristics, the change in which is to be minimised is one or more of the amplitude, direction, angular extent or polarisation of the energy.

3. A system according to claim 2 wherein the displacing means is arranged to provide independent displacement of the radiation lobe in two mutually orthogonal directions.

4. A system according to claim 3 wherein the displacing means is arranged to provide independent displacement of the radiation lobe in three mutually orthogonal directions.

5. A system according to claim 1 wherein the antenna is a mechanical antenna and the displacing means comprises means for displacing the antenna with respect to the transmissive surface.

6. A system according to claim 1 wherein the antenna is a phased array antenna and the displacing means comprises means for displacing the antenna with respect to the transmissive surface.

7. A system according to claim 1, the antenna being of a type wherein displacement of a radiation lobe thereof is effected electronically.

8. A system according to claim 1 further comprising a first and second support members, the first support member mounting the antenna, and the second support member pivotally mounting the first support member such that the first support member is rotatable in elevation and further comprising means for rotating the second support member in azimuth.

9. A method of transmitting or receiving radiation through a transmissive surface using an antenna, the method comprising the steps of:

steering a radiation lobe of the antenna with respect to the transmissive surface in at least one of azimuth and elevation; and displacing said radiation lobe of the antenna with respect to the transmissive surface to minimise a change in at least one characteristic of the radiation on passing through the transmissive surface.

10. The method of claim 9 wherein the step of displacing a radiation lobe of the antenna with respect to the surface is performed by displacing the antenna with respect to the transmissive surface.

11. The method of claim 10 comprising the steps of:

(a) for each of a series of sets characteristics of transmitted or received radiation, establishing antenna positions with respect to the surface for which a change in a characteristic, or combination of characteristics, of the radiation on passing through the transmissive surface is less than a pre-determined value; and (b) displacing the antenna as necessary to a position determined in step (a).

12. A computer program for implementing a method according to claim 9.

* * * * *